US007209106B2

(12) United States Patent
Lu et al.

(10) Patent No.: US 7,209,106 B2
(45) Date of Patent: Apr. 24, 2007

(54) HIGH-QUALITY-IMAGE LIQUID CRYSTAL DISPLAY DEVICE AND THE DRIVING METHOD THEREOF

(75) Inventors: Yi-Liang Lu, Hsinchu (TW); Yi-Fan Chen, Taichung (TW); Cheng-Jung Chen, Miaoli Hsien (TW); Yuh-Ren Shen, Tainan (TW)

(73) Assignee: Vastview Technology, Inc. (TW)

( * ) Notice: Subject to any disclaimer, the term of this patent is extended or adjusted under 35 U.S.C. 154(b) by 298 days.

(21) Appl. No.: 10/646,844

(22) Filed: Aug. 25, 2003

(65) Prior Publication Data

US 2005/0057471 A1 Mar. 17, 2005

(51) Int. Cl.
*G09G 3/36* (2006.01)
*G09G 5/10* (2006.01)

(52) U.S. Cl. ..... 345/89; 345/690

(58) Field of Classification Search ..... 345/87–89, 345/98–100, 204, 690
See application file for complete search history.

(56) References Cited

U.S. PATENT DOCUMENTS

| | | | | |
|---|---|---|---|---|
| 5,734,419 | A * | 3/1998 | Botsford et al. | 348/97 |
| 6,756,955 | B2 * | 6/2004 | Someya et al. | 345/88 |
| 2003/0095090 | A1 * | 5/2003 | Ham | 345/87 |
| 2003/0098839 | A1 * | 5/2003 | Lee | 345/89 |
| 2003/0210217 | A1 * | 11/2003 | Lee | 345/89 |

* cited by examiner

*Primary Examiner*—Amr A. Awad
*Assistant Examiner*—Stephen Sherman
(74) *Attorney, Agent, or Firm*—Lowe Hauptman & Berner, LLP

(57) ABSTRACT

A liquid crystal display (LCD) device and a driving method thereof are disclosed. In order to obtain high-quality images, a signal preprocessor is incorporated in the gray signal modulator of conventional LCDs. The signal preprocessor can be specifically designed as a noise-reduction preprocessor for suppressing the noise induced from the input gray signals, or designed for detecting a certain character of input gray signals for further processes. After be processed by the signal preprocessor, optimized modified gray signals can be obtained from the signal converter for driving the LCD, thereby producing high-quality images.

7 Claims, 9 Drawing Sheets

HIGH-QUALITY-IMAGE LIQUID CRYSTAL DISPLAY DEVICE AND THE DRIVING METHOD THEREOF

FIELD OF THE INVENTION

The present invention relates to a liquid crystal display (LCD) device and the driving method thereof, and more particularly, relates to an improved driving method for a LCD device to produce high image quality, by using a preprocessor for suppressing the noise induced form the input gray signals, and/or for detecting the frame rate of the gray signals to eliminate the possible over or under compensation which can be used in TV monitor, PC, PDA monitors, and the like.

BACKGROUND OF THE INVENTION

The screen of a LCD device generally comprises many liquid crystal cells arranged in columns and rows, forming a pixel array to display images. In each pixel, the orientation of liquid crystal molecules can be controlled by the applied voltage. Since the intensity of light passing through a liquid crystal cell depends sensitively on the orientation of the liquid crystal molecule, the pixel array can therefore display images by applying voltage signals in accordance with input video signals. However, due to its inherent limitations, it requires a relatively long response time for a liquid crystal molecule in a certain orientation to be changed into another orientation as the applied electric field is changed accordingly. This response time is determined by the inherent property of the liquid crystal molecule, such as viscosity, dielectric and elastic constants. On the other hand, the response time also depends on the design of LCD panel, such as the thickness of the gap between two electrodes. For a twisted-nematic mode liquid crystal, the typical rise time is about 20–80 ms, and the fall time is about 20-30 ms. However, this time scale is still longer than a typical frame interval (typically 16.67 ms). This means that the liquid crystal molecules in each pixel cannot reach the desired orientation during one frame interval, so that desired brightness of each pixel cannot be reached, thus resulting in afterimage and blurred image when displaying a high-speed moving object.

Except looking for faster liquid crystal materials, the problem of afterimage caused by slow response time can also be overcome by suitable driving method for the LCD device. In general, the problem of afterimage can be effectively reduced by a gray signal modulator, which modulates the input gray signal and applies the modulated gray signal to the liquid crystal cell, thereby obtaining the desired color and brightness in each pixel during one frame interval.

FIG. 1 shows schematically a block diagram for a typical LCD device, which comprises a gray signal modulator 10 for receiving and modulating the input gray signals, a timing controller 11 for controlling the signal sequence and synchronization, a data driver 12 for converting the modulated gray signal to the corresponding voltage data sequence, a gate driver 13 for continuously supplying scanning signals, and a LCD panel 14, comprising a plurality of gate lines 15 for transmitting scanning signals, a plurality of data lines 16 being insulated from and crossing the gate lines 15 for transmitting image signals, and an array of pixels forming by the areas surrounded by said gate lines 15 and said data lines 16.

As can be inferred from FIG. 1, the gray signal modulator 10 plays an important role in the LCD device and the driving circuit thereof. To reduce the problem of afterimage, the original gray signal was first processed by the gray signal modulator 10. The modulated gray signal was then sent into the driving circuit to provide suitable data voltage to each pixel of the LCD device in order to display the desired color and brightness accurately.

FIG. 2 shows a schematic diagram for a conventional gray signal modulator and the operation principle thereof. It comprises an input terminal 20 for receiving gray signals of input images, a frame memory 21 for storing preceding field image data, a frame memory controller 22 for controlling the frame memory 21 and the reading/writing processes therein, a signal converter 23 for modifying the input gray signals, a signal output terminal 24 for sending the modified gray signals to the data driver 12. The main function of the signal converter 23 is to compare the current field image data with the preceding field image data in the frame memory 21 and send out after modifying the output data to a suitable voltage level by compensation voltages. FIGS. 3A and 3B illustrate how the signal modulator modifies the input gray signals. In FIG. 3A, due to the slow response time of the liquid crystal molecules, the output brightness cannot reach the desired brightness during one frame interval. However, as shown in FIG. 3B, after modifying the input gray signals by compensation voltages, the output brightness become able to reach the desired brightness of the source image during one frame interval, thereby the problem of afterimage and blurred image caused by the slow response time can be effectively eliminated. In general, to efficiently process the compensation voltages in the signal converter, a presetting look-up table is commonly used for quick response.

While the technique described above can effectively eliminate the problem of afterimage caused by the slow response time of liquid crystal molecular, however, the noise induced by the gray signal modulator is not taken into account. As can be inferred from FIG. 3, the main function of compensation voltage is to amplify the input gray signal. However, such amplification will also enhance noise, leading to lower signal-to-noise ratio (S/N ratio) and hence lower image quality. On the other hand, the different frame-rate systems are not taken into account in the design of conventional LCD driving method. In fact, when the LCD device is designed for a certain frame-rate system, the response of the liquid crystal molecule during one frame interval will also be different, thereby leading to over (or under) compensation if the frame rate is slower (or faster) than the design. Therefore, to obtain the optimized image quality, the abovementioned problems should be overcome by improving the design of driving method of a LCD device, specifically its design for the preprocessor in the gray signal modulator.

SUMMARY OF THE INVENTION

The object of the present invention is to provide a LCD device and a driving method thereof that can produce high quality images.

The driving method for a LCD device in the present invention incorporates a signal preprocessor in the gray signal modulator of conventional LCDs. The main function of signal preprocessor is to preprocess the input gray signals, so that optimized gray signals can be obtained from the signal converter and thereby producing high-quality images.

The signal preprocessor of the present invention can be specifically designed as a noise-reduction preprocessor for suppressing the noise induced from the input gray signals. On the other hand, the signal preprocessor can also be specifically designed as a frame-rate detection preprocessor for detecting the frame rate of the input gray signals, which can eliminate the possible over or under compensation caused by different frame-rate systems.

The feature of the present invention is not to modify the framework of conventional LCDs, by instead of providing a new driving method to increase the response time of a LCD device and improve the image quality by considering the character of the input gray signal.

DETAILED DESCRIPTION OF PREFERRED EMBODIMENTS

Figure 1:
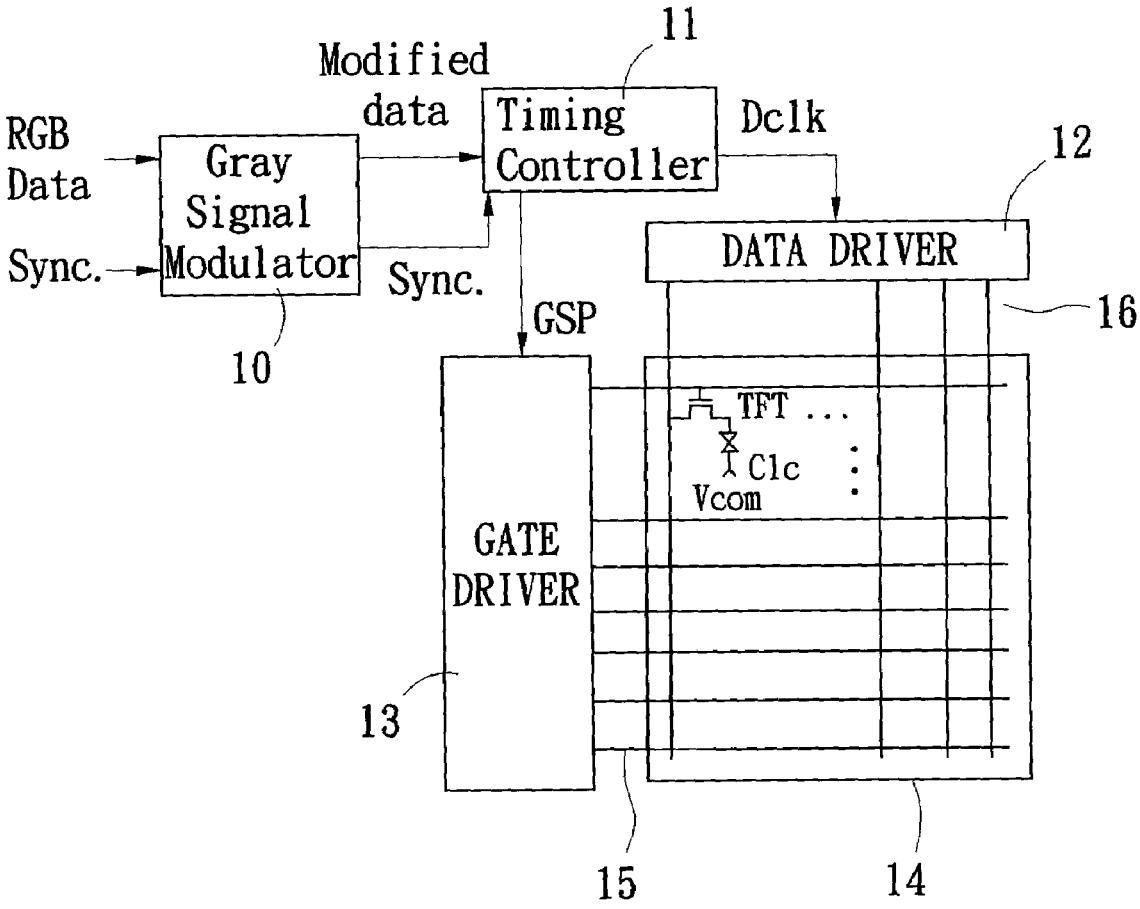
Fig. 1 (Prior Art)
FIG. 1 is a schematic diagram showing the main components of a LCD device.
Figure 2:
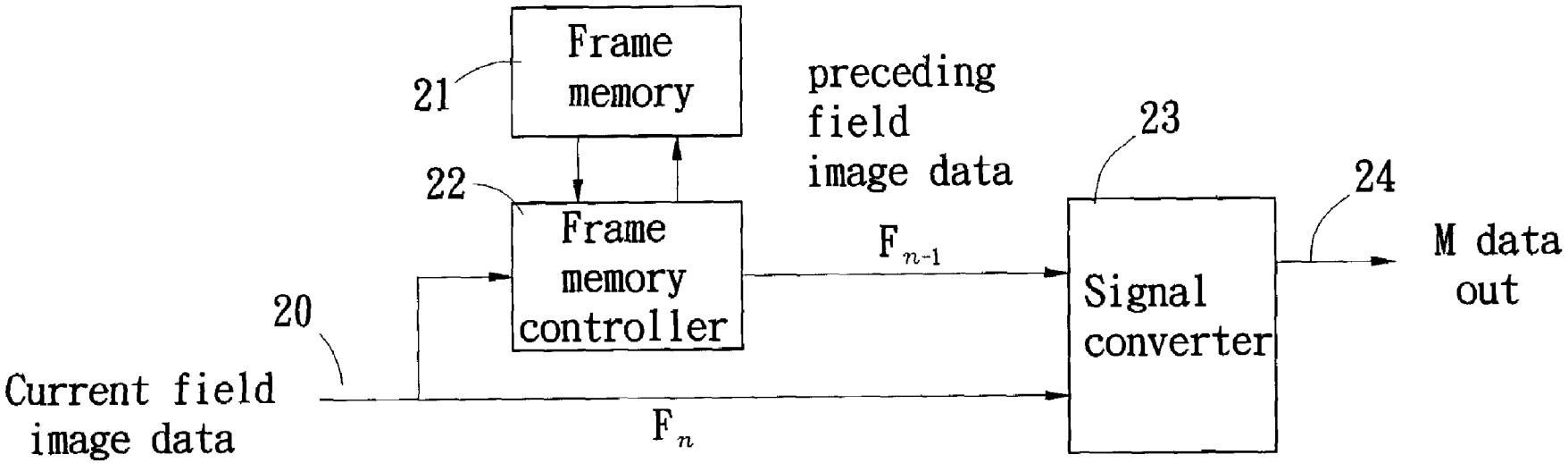
Fig. 2 (Prior Art)
FIG. 2 is a block diagram showing the functions of a conventional gray signal modulator for improving the response of output gray signals.
Figure 3A:
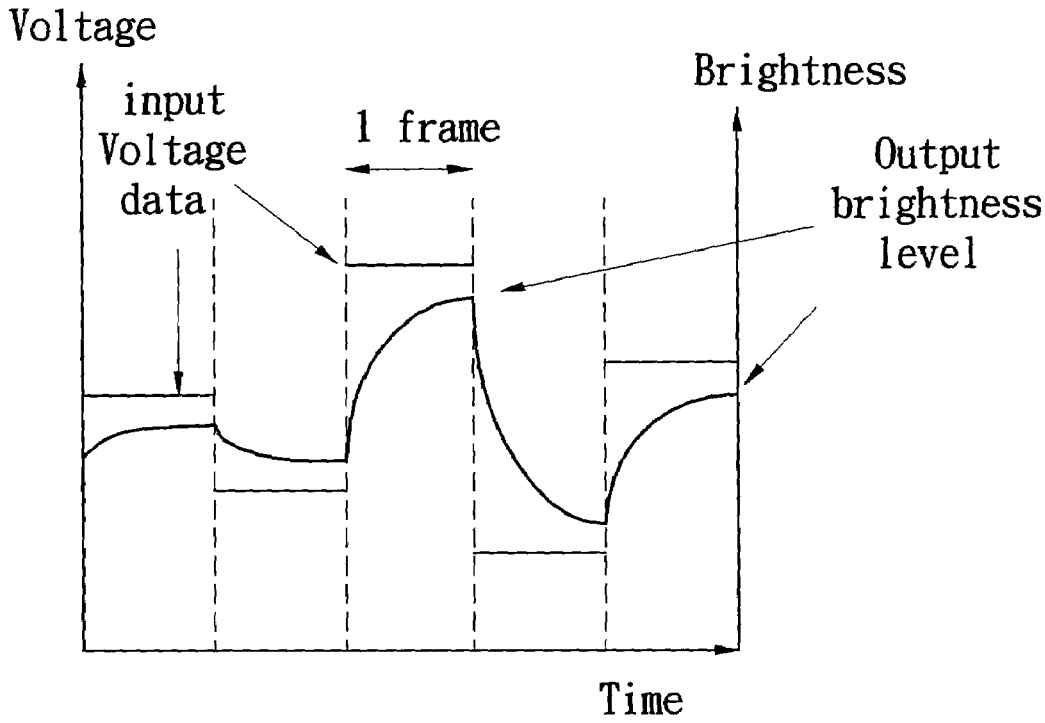
Fig. 3A (Prior Art)
FIGS. 3A and 3B illustrate how the conventional signal modulator modifies the input gray signals, and thereby obtaining the desired colors or brightness during one frame interval.
Figure 3B:
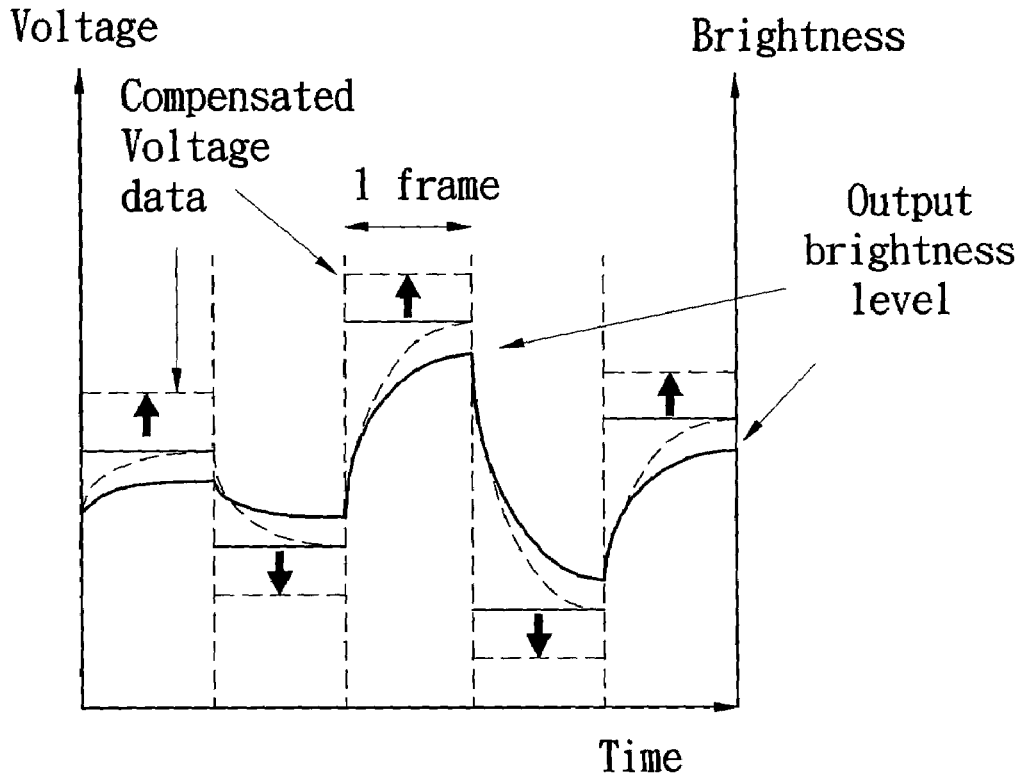
Fig. 3B (Prior Art)
Figure 4:
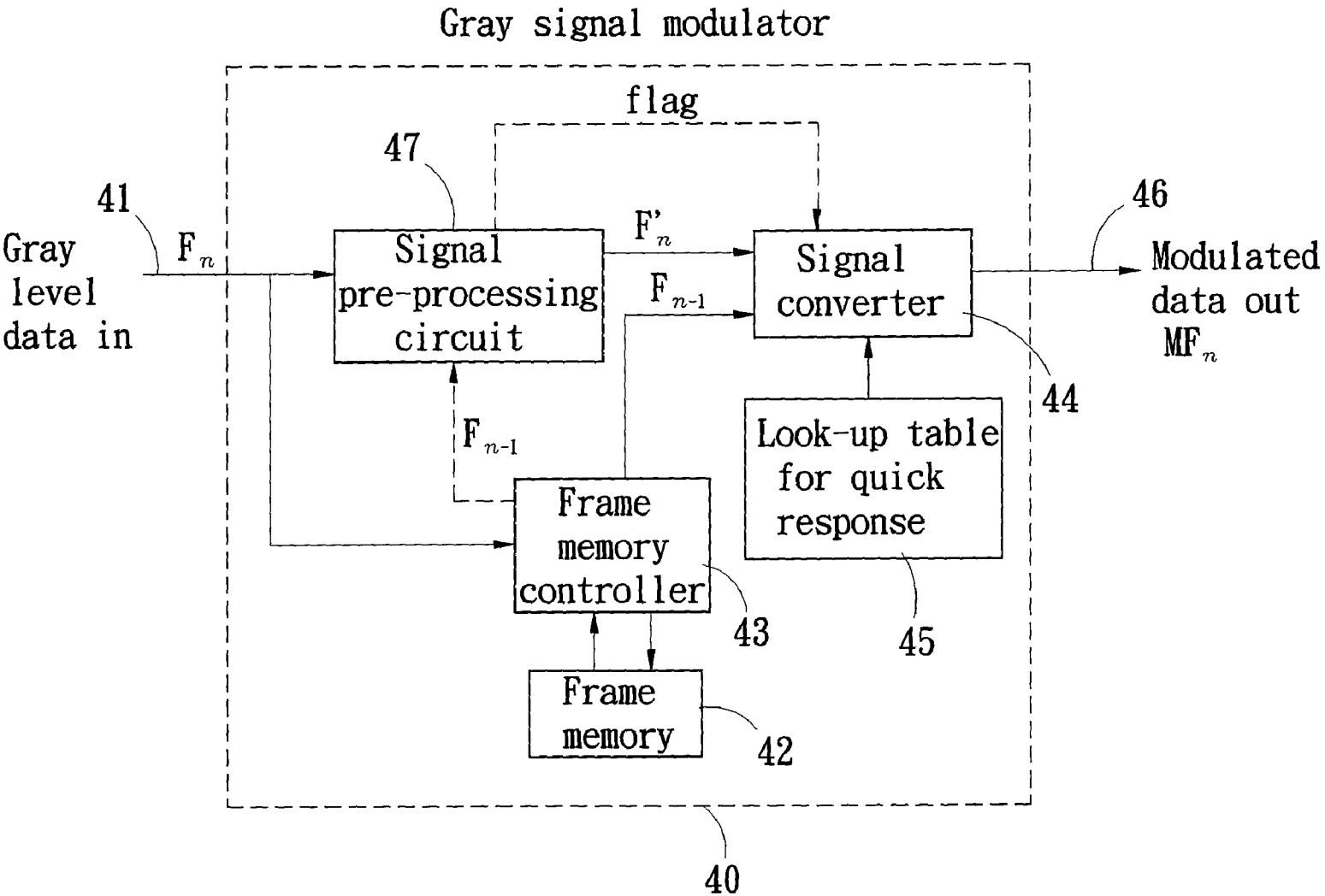
FIG. 4 is the gray signal modulator of the present invention, wherein a signal preprocessor is used for processing the input gray signals or detecting a certain character thereof.

The schematic diagram shown in FIG. 4 is a modified gray signal modulator 40 of the present invention. The modified gray signal modulator 40 is similar to the gray signal modulator of the prior art shown in FIG. 2, having a gray signal input terminal 41, a frame memory 42, a frame memory controller 43, a signal converter 44, a look-up table 45 for quick response of the change of signals and a gray signal output terminal 46. The feature of the present invention is that a signal preprocessor 47 is incorporated between the gray signal input terminal 41 and the signal converter 44. When the current field image data $F_n$ is received by the signal input terminal 41, it can be modified to $F_n'$ by the signal preprocessor 47. This modification data $F_n'$ can be obtained by considering the difference between the current field image data $F_n$ and the preceding field image data $F_{n-1}$ in the frame memory 42. After that, the $F_n'$ and the $F_{n-1}$ in the frame memory 42 are sending into the signal converter 44, and the modulated gray signal data $MF_n$ can be quickly obtained by via referring to the signal converter 44 and a look-up table 45. The modulated gray signal data $MF_n$ provides compensation voltages accurately so that the desired color or brightness of each pixel can be achieved. In some circumstances, the signal preprocessor 47 can be specifically designed as a detection preprocessor for detecting a certain character of the input gray signals. In this case, the signal preprocessor 47 is not necessary to consider the preceding field image data $F_{n-1}$ in the frame memory 42. The suitable modulated gray signal $MF_n$ can be obtained by just sending a corresponding flag to the signal converter 44 for selecting suitable converting scheme.

Figure 5:
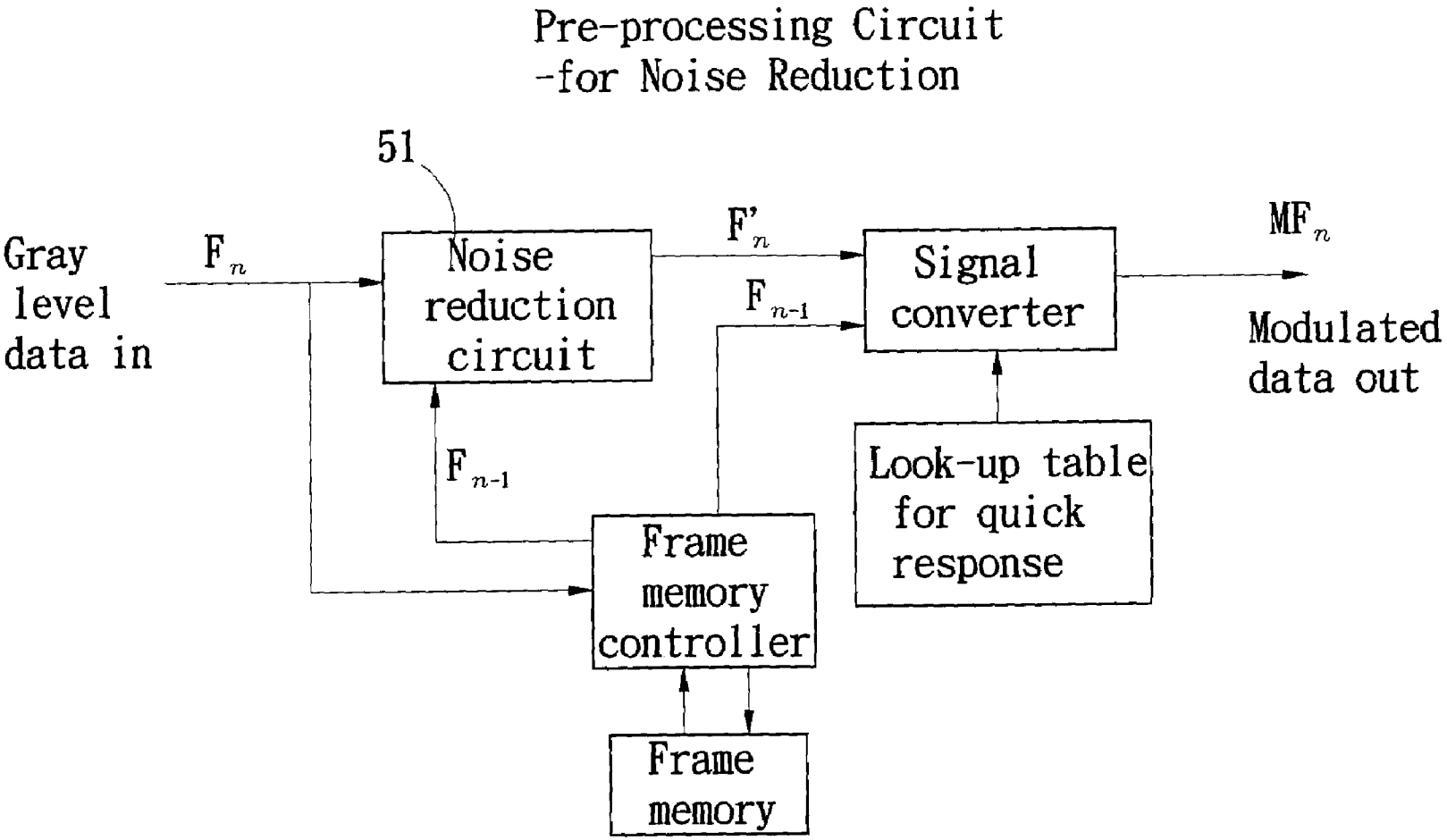
FIG. 5 is the signal preprocessor of the present invention specifically designed as a noise-reduction preprocessor for suppressing the noise induced from the input gray signals.
Figure 6A:
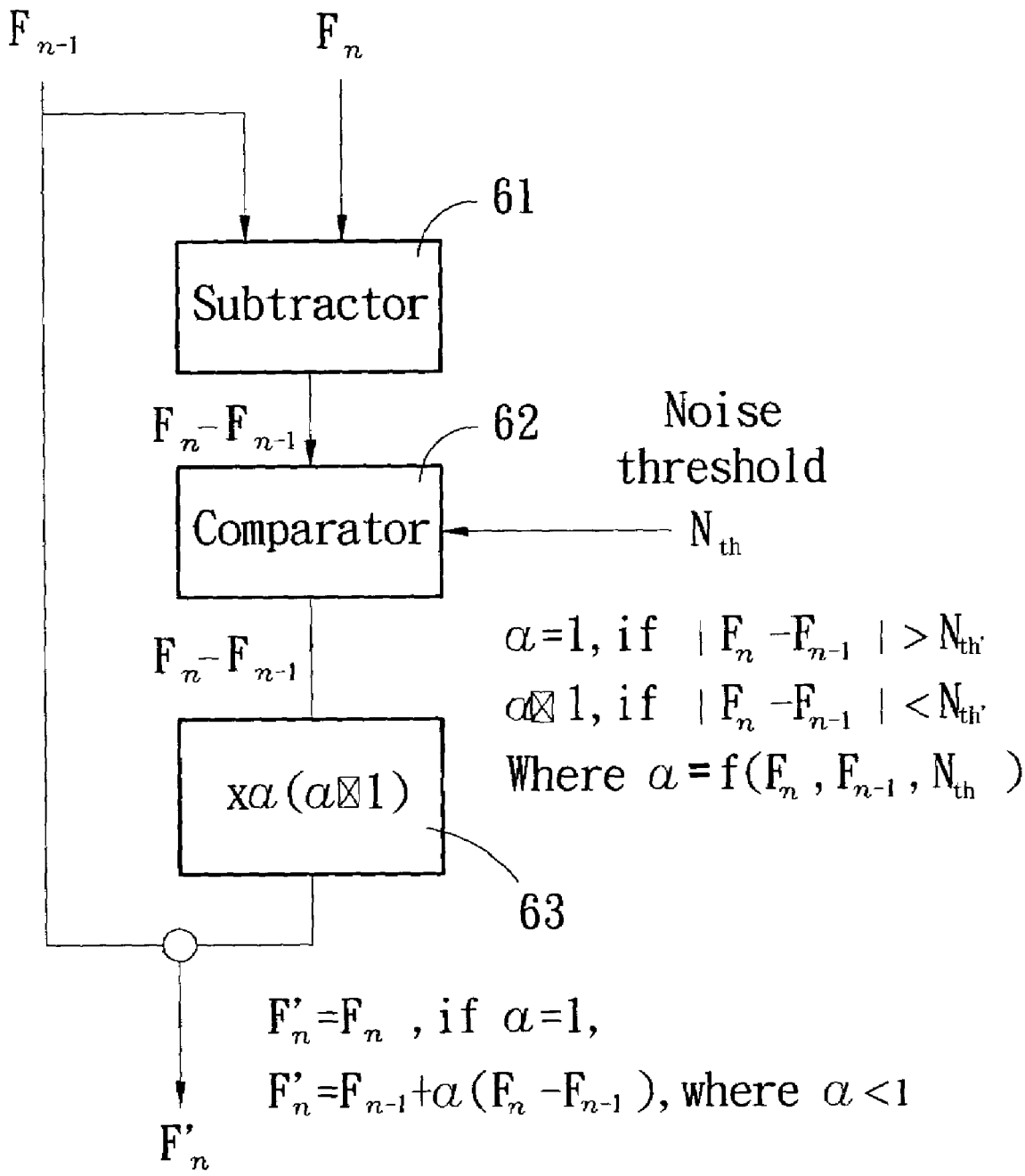
FIG. 6A shows the operation principle of the noise-reduction preprocessor of the present invention.
Figure 6B:
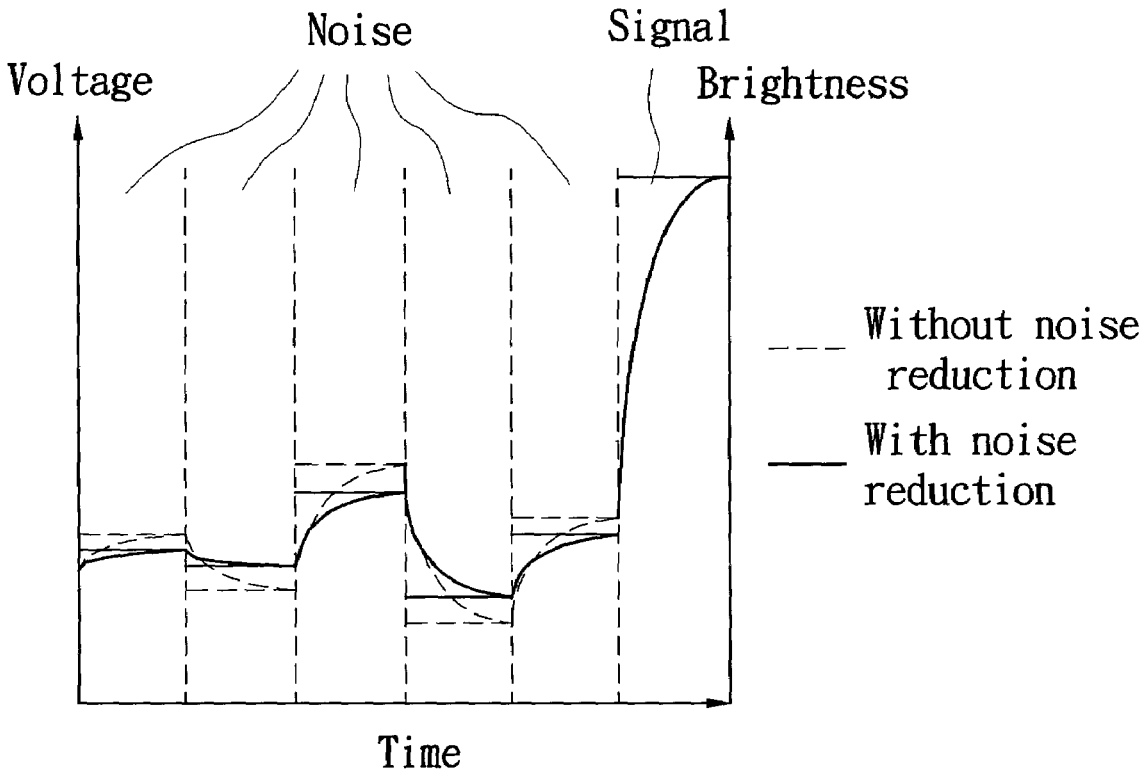
FIG. 6B illustrates the effects of noise-reduction preprocessor on the input gray signals.

The gray signal modulator 40 as described in FIG. 4, wherein the signal preprocessor 47 can be specifically designed as noise-reduction preprocessor for suppressing the noise induced from the input gray signal, which is the first preferred embodiment of the present invention. FIG. 5 shows a schematic diagram for the first preferred embodiment, wherein the noise-reduction preprocessor 51 can effectively reduce the noise entering the signal converter. The method for noise-reduction is illustrated by the schematic diagram shown in FIGS. 6A and 6B. First, as can be seen in FIG. 6A the current filed image data $F_n$ and the preceding filed image data $F_{n-1}$ were sent into a subtractor 61. Then the obtained $F_n-F_{n-1}$ was sent into a comparator 62 for comparing with a presetting noise threshold $N_{th}$. A modification factor a ($a \leqq 1$) 63 is then determined by the results of comparison as follows, $$a=1, \text{ if } |F_n-F_{n-1}|>N_{th},$$

$$a \leqq 1, \text{ if } |F_n-F_{n-1}| \leqq N_{th},$$

where a satisfies $a=f(F_n,F_{n-1},N_{th})$. After determining the modification factor a' the modified image data $F_n'$ can be obtained by the following relation, $F_n'=F_n$, for a=1, and $$F_n'=F_{n-1}+a(F_n-F_{n-1}), \text{ for } a<1.$$

In other words, when $|F_n-F_{n-1}|>N_{th}$, the $F_n$ is considered as a signal and the output $F_n'$ doesn't need any modification. However, when $|F_n-F_{n-1}| \leqq N_{th}$, the $F_n$ is considered as a noise so that the $F_n'$ is modified by a factor of a (a<1) to suppress the noise. The method for noise reduction can be further explained by FIG. 6B. As can be seen in this figure, the noise-induced fluctuation in signal can be effectively reduced. On the other hand, because the "signal" has not been modified, the voltage level of the original image data can be preserved.

Figure 7:
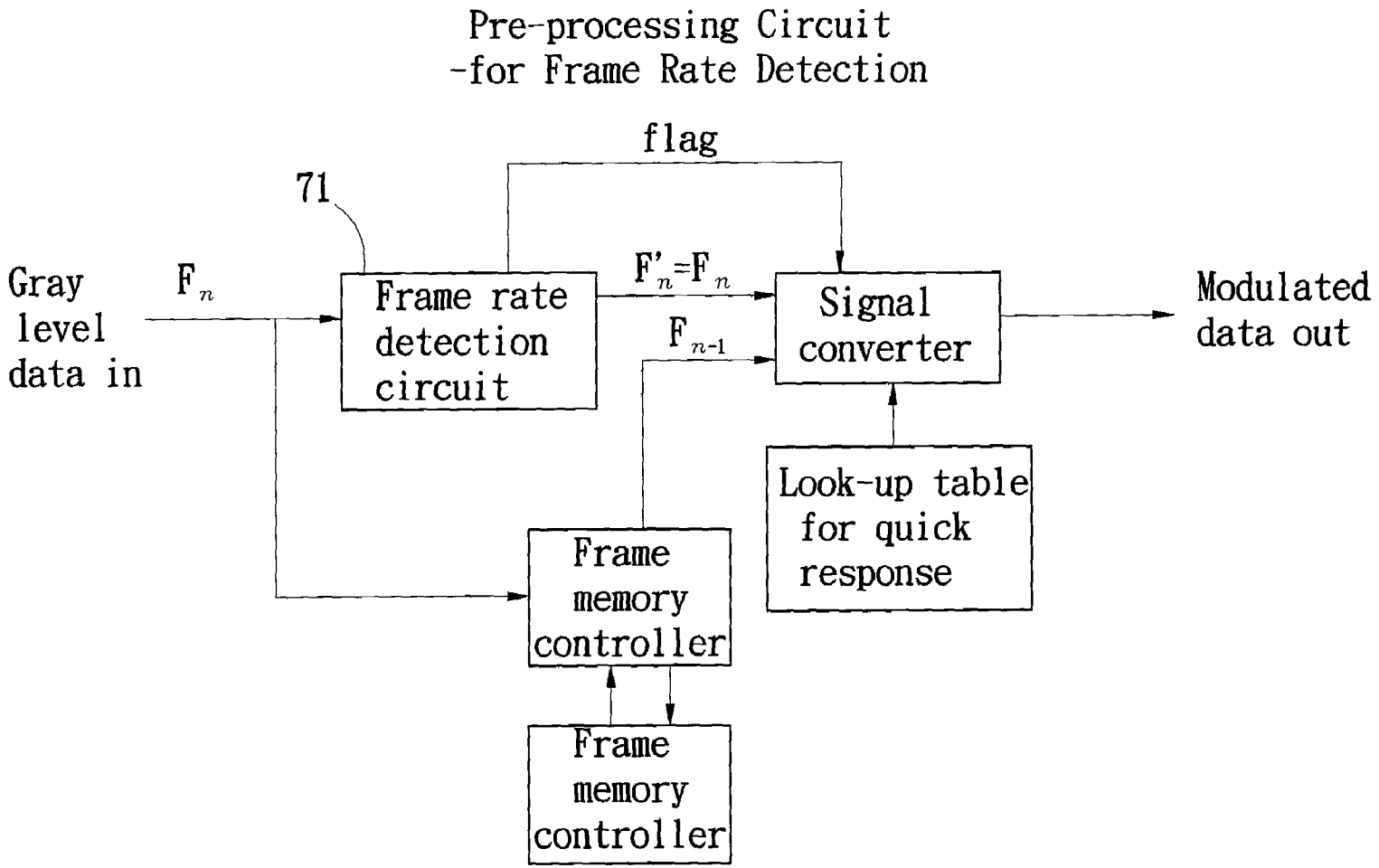
FIG. 7 is the signal preprocessor of the present invention specifically designed as a frame-rate detection preprocessor for detecting the frame rate of the input gray signals.
Figure 8:
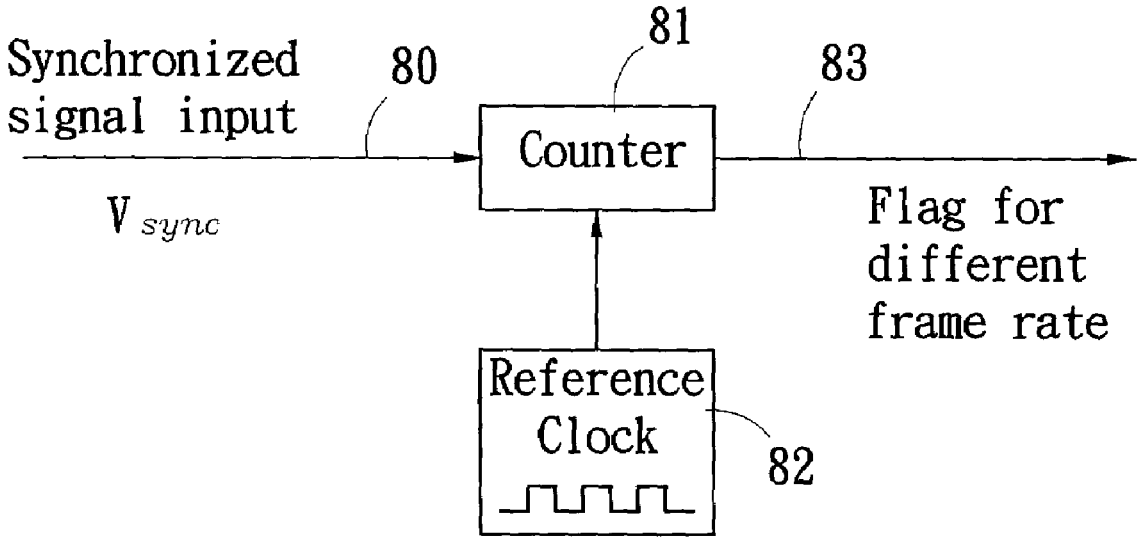
FIG. 8 shows the operation principle of the frame-rate detection preprocessor of the present invention.

The gray signal modulator 40 as described in FIG. 4, wherein the signal preprocessor 47 can also be specifically designed for detecting a certain character of the input signal, which is the second preferred embodiment of the present invention. FIG. 7 shows a schematic diagram for the signal preprocessor, which is specifically designed as a frame-rate detection preprocessor 71 for eliminating the over compensation effect induced by the different input frame rates. The method for frame-rate detection can be illustrated by the diagram shown in FIG. 8. It generally comprises an input terminal 80 for inputting synchronization signal $V_{sync}$, a counter 81, a reference clock 82 and an output terminal 83 for outputting the flag of corresponding frame rate. By using the input synchronization signal $V_{sync}$ and the reference clock 82, the counter 81 can accurately determine the frame rate of the input signals and send out the corresponding flag. By using this flag, suitable converting scheme or (look-up table) can be determined so that the over or under compensation caused by different rate systems can be eliminated.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

What is claimed is:

1. A liquid crystal display (LCD) device, comprising:

a gray signal modulator for receiving gray signals of the input image data, and for outputting modified gray signals by considering the current and the preceding field image data, and by considering the character of input image data; said gray signal modulator further comprising:

an input terminal for receiving the gray signals of input image data;

a frame memory for storing the preceding field image data of the input gray signals;

a controller for controlling the frame memory and the reading and writing processes thereof;

a signal preprocessor for processing the gray signal from the input terminal or detecting the character thereof; the signal preprocessor considering the differences between the current and preceding field image data for providing the gray signal data converter to select a suitable converting scheme to reduce the noise induced from the input gray signals, and having further function to cover compensation if the video systems, frame rates, images with different signal-to-noice ratios or interfaces are varied;

a gray signal data converter for outputting the modified gray signals by considering the gray signals of the preceding field image data transmitted from the frame memory and the outputs from the signal preprocessor, and an output terminal for transmitting the modified gray signal to the data driver;

a data driver for converting the modified gray signals into the corresponding data voltages for driving the liquid crystal molecules in each to produce image signal;

a gate driver for continuously supplying the scanning signals, and a liquid crystal display panel, comprising a plurality of gate lines for transmitting said scanning signals, a plurality of data lines being insulated from and crossing the gate lines for transmitting image signals, and an array of pixels forming by the areas surrounded by the said gate lines and said data lines.

2. The gray signal modulator as described in claim 1, wherein the signal preprocessor is specifically designed as a noise-reduction preprocessor for reducing the noise induced from the input gray signals.

3. A method for driving a LCD device, comprising:

inputting gray signals of input image data into a gray signal modulator;

comprising a signal preprocessor, which has function for reducing the noise of input gray signals by considering the difference between the current and the preceding field image data, wherefrom the input gray signal is considered as signal and is outputted directly if the difference exceeds a presetting noise threshold, otherwise the input gray signal is considered as noise and is outputted after noise reduction modification, and has further function to cover compensation if the frame rate is varied;

modifying the input gray signals into modified gray signals by the gray signal modulator;

outputting the modified gray signals to a data driver; converting the modified gray signals into corresponding image data voltages by the data driver, and driving each pixel of the LCD device by the image data voltages, thereby achieving the desired brightness in each pixel of the LCD device wherein the method for noise reduction further satisfies $$F_n' = F_n \text{ if } |F_n - F_{n-1}| \geqq N_{th},$$

$$F_n' = F_{n-1} + a(F_n - F_{n-1}), \text{ if } |F_n - F_{n-1}| < N_{th};$$

wherein $F_n$ is the current field image data, $F_{n-1}$ is the preceding field image data, $F_n'$ is the modified current field image data, $N_{th}$ is a presetting noise threshold and a is a presetting parameter, which satisfies $0 \leqq a < 1$, or can be changed in accordance with the noise level, satisfying $a = f(F_n, F_{n-1}, N_{th})$.

4. The method for driving a LCD device as described in claim 3, wherein the method for modifying the input gray signals by the gray signal modulator is achieved by considering the current and the preceding field image data, and by considering the character of input gray signals, thereby outputting the suitable modified gray signals.

5. The method for driving a LCD device as described in claim 4 wherein the method for modifying the input gray signals by the gray signal modulator further comprises a signal preprocessor for detecting a certain character of the input gray signals and then sending a flag that represents said character to the signal converter for providing different signal converting schemes.

6. The method for driving a LCD device as described in claim 5, wherein said character of input gray signals detected by the signal preprocessor includes different video systems, different frame rates, images with different signal-to-noise ratios, different interfaces or user dependent parameters.

7. The method for driving a LCD device as described in claim 5, wherein said different signal converting schemes can be achieved by using multiple look-up tables.

* * * * *